US008256346B2

(12) United States Patent
Lewis et al.

(10) Patent No.: US 8,256,346 B2
(45) Date of Patent: Sep. 4, 2012

(54) PLATELESS LITHOGRAPHIC PRINTING

(76) Inventors: Thomas E. Lewis, East Hampstead, NH (US); Nanda Nathan, Westford, MA (US)

( * ) Notice: Subject to any disclaimer, the term of this patent is extended or adjusted under 35 U.S.C. 154(b) by 1049 days.

(21) Appl. No.: 12/187,132

(22) Filed: Aug. 6, 2008

(65) Prior Publication Data

US 2010/0031838 A1 Feb. 11, 2010

(51) Int. Cl.
*B41M 1/06* (2006.01)
*B41F 1/18* (2006.01)

(52) U.S. Cl. ..... 101/450.1; 101/130; 101/142

(58) Field of Classification Search ..... None
See application file for complete search history.

(56) References Cited

U.S. PATENT DOCUMENTS

| | | | |
|---|---|---|---|
| 3,800,699 | A | 4/1974 | Carley |
| 6,341,559 | B1 | 1/2002 | Riepenhoff et al. |
| 7,191,705 | B2 | 3/2007 | Berg et al. |
| 2004/0182270 | A1 | 9/2004 | Wiedemer et al. |
| 2005/0115429 | A1 | 6/2005 | Link |
| 2007/0062389 | A1 | 3/2007 | Link |

FOREIGN PATENT DOCUMENTS

| | | |
|---|---|---|
| EP | 0101266 | 2/1984 |
| EP | 1036655 | 9/2000 |
| EP | 1375136 | 1/2004 |
| WO | WO-03/070461 | 8/2003 |
| WO | WO-03/070466 | 8/2003 |
| WO | WO-03/070481 | 8/2003 |

OTHER PUBLICATIONS

International Search Report and Written Opinion, for PCT/US2009/052035, 13 pages.
Partial International Search Report, for PCT/US2009/052035, 5 pages.

*Primary Examiner* — Joshua D Zimmerman
(74) *Attorney, Agent, or Firm* — Bingham McCutchen LLP

(57) ABSTRACT

Embodiments of the present invention dispense with the need for lithographic printing plates, instead facilitating direct transfer of ink from a permanent cylinder to a recording medium. Accordingly, instead of being permanently modified to exhibit oleophilic and oleophobic (or hydrophilic) regions, the cylinder is effectively "programmed" with the image prior to each transfer of ink.

10 Claims, 4 Drawing Sheets

PLATELESS LITHOGRAPHIC PRINTING

FIELD OF THE INVENTION

The present invention relates to offset printing, and in particular to printing without the use of traditional printing plates.

BACKGROUND

Conventional techniques for printing in black-and-white and in color include letterpress printing, rotogravure printing and offset printing. These processes produce high-quality copies, but the printing members used to transfer ink, in an "imagewise" fashion onto a recording medium, are relatively expensive. Letterpress and gravure printing members, for example, are cut or etched using cumbersome photographic masking and etching techniques. Traditional offset lithography utilizes mats or films on which the image is present as a pattern of ink-accepting and ink-rejecting areas. In wet lithography, fountain solution is applied to hydrophilic plate areas, which are thereby rendered oleophobic and reject ink; the remainder of the plate is oleophilic, i.e., capable of accepting ink. In dry lithography, non-image regions of the plate are inherently oleophobic. In either case, the inked plate, which bears the imagewise pattern of ink, is brought into contact with a relatively soft blanket cylinder. From there, the ink is applied to paper or another recording medium brought into contact with the surface of the blanket cylinder.

Although lithographic printing plates are less expensive than letterpress and rotogravure printing members, they still represent a consumable material cost, and must be stored, handled, and disposed of after completion of a printing job.

SUMMARY

Embodiments of the present invention dispense with the need for lithographic printing plates, instead facilitating direct transfer of ink from a permanent cylinder to a recording medium. Accordingly, instead of being permanently modified to exhibit oleophilic and oleophobic (or hydrophilic) regions, the cylinder—or, more accurately, the combination of ink and fountain solution on the cylinder—is effectively "programmed" with the image prior to each transfer of ink. In particular, a transferable image is realized by selective removal of the fountain solution and/or by selective alteration of the properties of the ink (i.e., removal of a solvent component thereof), and the programming "tool" that achieves such removal is a hot spot on the surface of the cylinder. Preferably, the cylinder surface retains no memory of the spot heating. As a result, the invention facilitates a "variable-data" approach in which each printed sheet can be different from its predecessor.

In general, printing methods in accordance with the invention involve pre-wetting a lithographic surface and then creating a printable image by selective removal of the wetting fluid. The ability to erase the image without impractical or extreme measures represents an important advantage of this approach, and facilitates commercially practicable variable-data printing.

In accordance with the invention, a wetting fluid—i.e., a fluid to which ink will not adhere, such as fountain solution or, in the case of a single-fluid ink, the solvent component—is applied over a lithographic printing surface (typically the surface of a rotating master cylinder), and is selectively addressed by imagewise exposure to radiation (delivered, for example, via one or more lasers). In response to imagewise exposure, ink is selectively retained on, and prints from, the lithographic surface where so exposed.

In one aspect of the invention, the wetting fluid is a polar liquid, such as fountain or dampening solution, and is initially applied to the entire printing surface, which is hydrophilic (as defined below) and ink-receptive. Laser output is applied to the liquid-bearing printing area in an imagewise fashion, selectively but substantially removing the adsorbed liquid without damaging the printing surface. Ink is then applied over the printing area. The ink adheres to the surface only where the polar liquid has been removed by the laser, and is thereupon transferred to a recording medium. In some embodiments, the ink is a conventional oil-based ink, while in other embodiments, it is a single-fluid ink comprising a colorant and a polar solvent such that the ink and the polar liquid are applied simultaneously; laser output removes the solvent but not the colorant. The ink may also contain a sensitizer to enhance absorption of laser energy.

In another aspect, the wetting fluid is ink which, once again, is initially applied to the entire printing surface and is adsorbed thereon. The ink-bearing printing area is exposed to laser output in an imagewise fashion, thereby fixing the adsorbed ink on the printing surface in the exposed regions. A polar liquid is applied to the printing area to remove ink that has not received laser exposure, and the remaining ink is transferred to a recording medium.

Following ink application, the printing area may be erased by hand wiping or, more typically, automated application of a polar or ink-removing liquid; the application, exposure and transferring steps may then be repeated using the same or different printing data. Furthermore, the application and exposure steps may be repeated more than once in a given printing cycle—i.e., before ink is actually applied to the recording medium—in order to intensify the ink image for printing. For example, where the polar liquid is applied first, it is substantially removed with each iteration while ink continues to accumulate on the surface; and where ink is applied first, it augments with each repeated application where exposed to laser output.

The polar liquid may be an aqueous dampening or fountain solution. In preferred embodiments, the lithographic surface is metal, e.g., titanium. Methods in accordance with the invention may also include the step of removing vapor and debris during the exposing step.

BRIEF DESCRIPTION OF THE DRAWINGS

In the drawings, like reference characters generally refer to the same features throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

1. Basic Configuration and Operational Principles

Figure 1:
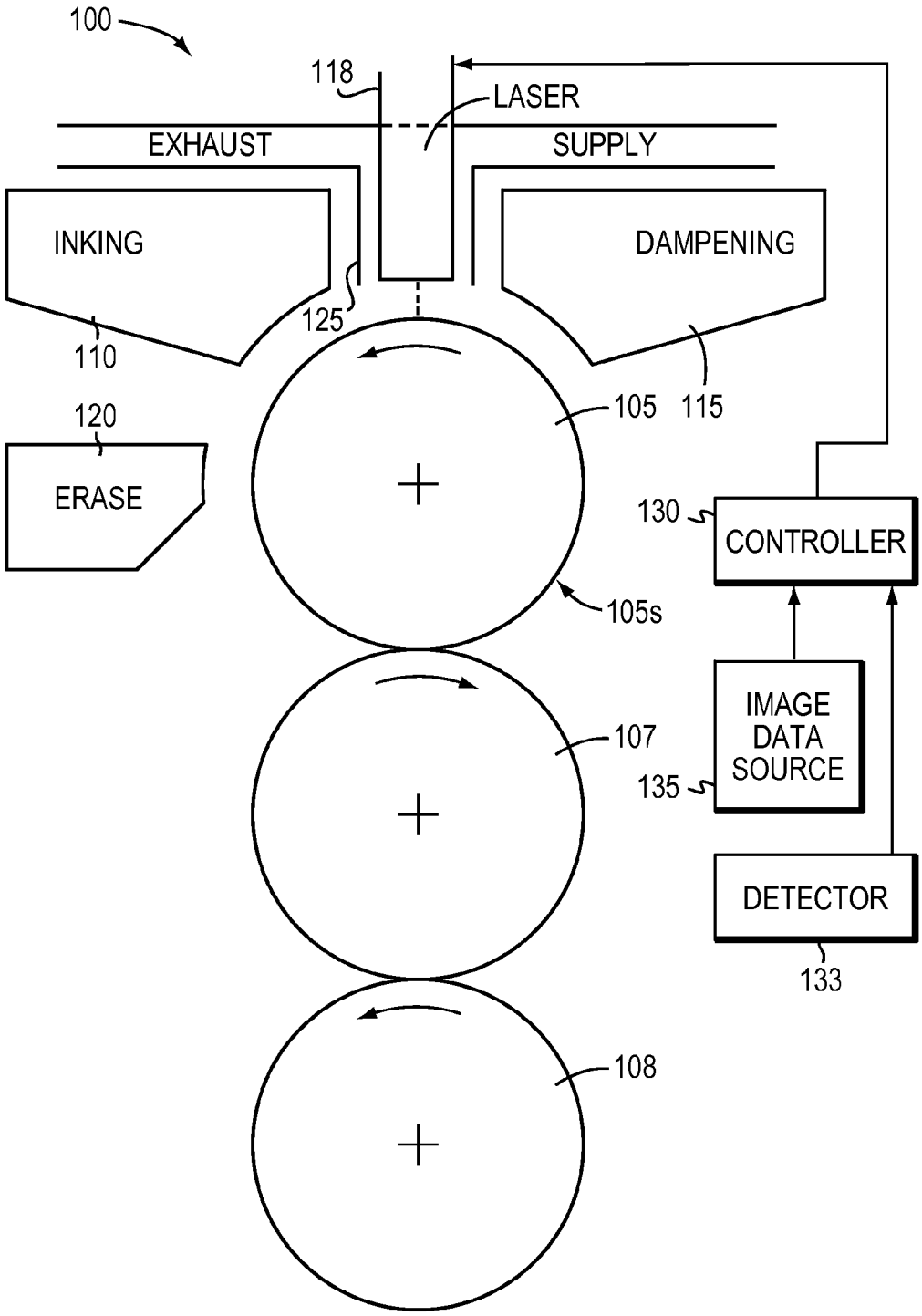
FIG. 1 schematically illustrates a representative imaging and printing configuration suitable for implementing embodiments of the present invention.

With reference to FIG. 1, in general overview, a printing press 100 in accordance with the invention may comprise a print cylinder 105 having a lithographic surface 105*s*. Cylinder 105 rotates in contact with a compliant blanket cylinder 107, and this cylinder, in turn rotates in contact with an impression cylinder 108. Recording media (e.g., paper) in sheet form passes through the nip n between cylinders 107, 108 before being discharged to the exit end of the press 100. Typically, cylinders 105, 107, 108 are geared together and driven in unison by a single drive motor.

Ink for inking plate 105 is delivered by an ink train 110, the outermost roll of which is in rolling engagement with plate 105 when press 100 is printing. A dampening system 115 applies a polar liquid, e.g., an aqueous medium such as dampening or fountain solution, to the lithographic surface 105*s* of print cylinder 105. The output(s) of a laser scanning system 118 selectively strike surface 105*s* in an imagewise fashion, either removing (e.g., ablating or vaporizing), on a point-by-point basis, dampening solution from the surface or fixing previously applied ink so as to resist removal. In ink-first embodiments, laser system 118 "dries" the ink to a quasi-stable state; once set, the exposed ink regions will be more resistant to removal by dampening. In dampening-first embodiments, the unremoved polar liquid corresponds to the background regions and resists ink. In all cases, the laser output is sufficiently powerful to exert the desired effect but without damaging surface 105*s*; by "damage" is meant a change to native lithographic affinity that would interfere with the function of the printing surface.

An erasing unit 120 may be included to ensure complete removal of ink prior to a succeeding print cycle. Thus, in dampening-first embodiments, erasing unit 120 may remove residual ink if a post-transfer application of dampening fluid by dampening system 115 is inadequate for this purpose; and in ink-first embodiments, erasing unit 120 may apply an ink-removal fluid to effectively remove the fixed ink from surface 105*s*. Suitable ink-removal fluids include conventional compositions for cleaning lithographic printing plates. Commonly, the blend is predominantly high-boiling (low vapor pressure) hydrocarbon solvents, but includes a low level of more active (polar) solvents and can include hydrocarbon-soluble surfactants to improve suspension of particulates (pigment particles, etc.). One preferred cleaning composition is an alkaline solvent-in water emulsion, typically containing ±30% petroleum distillates, emulsifying surfactants and a few percent of an alkaline additive. NaOH, KOH, Na silicates and K silicates are examples of commonly used additives, individually or in combination, to provide alkalinity. GREAT PLATES, supplied by Tower Products (Palmer, Pa.), is a commercial example.

It may also be desirable to include a debris-management system 125, which may surround the writing head on which laser(s) 118 are mounted.

System 125 minimizes vapor plumes that may result from the imaging process and contaminant build-up on optical components. Debris plumes are a well-known phenomenon that can cause lens surface deposits (which, in turn, results in beam blocking and localized overheating) and beam occlusion in laser-ablation systems for various kinds of imaging, e.g., lithographic plates, flexographic rolls and gravure (anilox) cylinders, and debris-management systems for addressing the problem are conventional. The system 125 has supply and exhaust manifolds. An air source, coupled to the supply manifold, provides purge air to displace the debris plume. For particularly sensitive systems, the purge air may need to be humidity and temperature controlled. An exhaust system, coupled to the exhaust manifold, removes air entraining the debris plume. Typically, the exhaust flow rate is slightly higher than that of the purge air so that air pressure in the region under management is slightly negative relative to that of the surrounding area, resulting in flow toward the exhaust. (A positive air pressure relative to the surrounding area will push air entraining the debris plume away from the exhaust system and into the surrounding area.) The system 125 may also include a "scrubber" to clean the exhausted air, depending on what is identified to be in the exhaust. This capability is particularly desirable if the exhausted air is vented into the working environment (e.g., press room) rather than to the exterior of the building.

The surface 105*s* is hydrophilic and ink-receptive. By "hydrophilic" is meant the ability to retain, in the presence of an applied force, an adsorbed layer of fluid to which ink will not adhere. In general, a hydrophilic surface in accordance herewith will preferentially retain the adsorbed layer of fluid relative to ink when both the fluid and ink are on the surface in the presence of an applied force. A metal surface 105*s*—either the surface of the cylinder 105 itself, or a metal surface layer or sheet (typically having a thickness of 0.02 inch or less) applied to the cylinder 105—such as titanium is preferred. Six-mil titanium sheets, wrapped around a conventional print or offset cylinder and cleaned to remove milling lubricants, have been employed to advantage and are particularly suited to small-format presses; thicker sheets may be preferred in removable sleeve embodiments as described below, or for larger-format presses. In addition, physical surface modification (e.g., imparting a controlled surface roughness and/or chemical modification of the surface) can be used to enhance the performance of titanium sheets. Such modifications can be imparted using techniques well known in the art for conventional metal finishing.

Printing techniques in accordance with the invention are desirably compatible with routinely available lithographic printing inks. Laser sensitizers, while not necessary to performance, may nonetheless be utilized to optimize or fine-tune ink behavior. A wide range of sensitizers may be employed, e.g., inorganic pigments such as the relatively transparent conductors ITO, $V_xSn_{(1-x)}O_2$ and $Sb_xSn_{(1-x)}O_2$; and/or organics such as pigments or dyes (e.g., metal chelates for lasers operating at ≈1.5 μm).

Embodiments of the invention can accommodate separate or integrated dampening approaches, the latter referring to dampening fluid and ink applied simultaneously from a single assembly. Conventional oil-based or single-fluid inks may be employed. Single-fluid inks include water or a polar solvent as a separate phase incorporated into the ink that separates upon application to produce a dampening fluid. The specifics of separation are not a factor as the effect is essentially equivalent to an integrated dampening approach.

In one printing mode, a polar liquid such as fountain or dampening solution is initially applied by dampening system 115 to the entire printing surface 105*s*. The output of laser system 118 is selectively applied to the surface 105*s* in an imagewise fashion as described below. The laser output substantially removes the adsorbed liquid without damaging the printing surface 105*s*. Ink is then applied thereover by inking system 110. The ink adheres to the surface 105*s* only where the polar liquid has been removed by the laser system 118, and is thereupon transferred to a recording medium passing through the nip n.

It is found that the color of the ink does not significantly influence the imaging process. Cyan, magenta, yellow and black inks, for example, dry under laser exposure, suggesting that significant laser absorption is provided by the metal sheet or cylinder. This can reduce or eliminate the need for inks that include laser absorbers (sensitizers).

In another printing mode, ink rather than a polar liquid is initially applied to the plate 105, and is adsorbed onto the printing surface 105*s*. The ink-bearing printing area is exposed to the output of laser system 118 in an imagewise fashion, thereby fixing the adsorbed ink on the printing surface 105*s* in the exposed regions. The polar liquid is applied to the printing area by dampening system 115 to remove ink that has not received laser exposure, and the the remaining ink is transferred to a recording medium passing through the nip n.

Following ink application, the printing area may be erased by hand wiping or application of a polar or ink-removing liquid; the application, exposure and transferring steps may then be repeated using the same or different printing data. Furthermore, the application and exposure steps may be repeated more than once in a given printing cycle in order to intensify the ink image for printing. In particular, depending on various factors (most notably the nature of the applied ink), the process may not produce a printable image when laser exposure (imaging) is limited to a single revolution of the plate cylinder 105. This can occur with lithographic printing inks that flow too slowly to build enough mass from a single application. It may, for example, require two or more passes to build enough ink to establish an equilibrium flow from the inking system 110 to the recording medium.

The image is temporary and may be removed as discussed above. Convenient erasability may result from inclusion, in typical lithographic inks, of a high-boiling-point solvent component (commonly referred to as an "ink oil") that contributes to "quick set"—i.e., a rapid gelling that results from the solvent component migrating into the print sheet combined with restructuring of the ink as it leaves the high-shear application and transfer environment. Laser exposure may result in evaporation of this solvent component from the ink being picked during repeated revolutions past the laser source 118. However, what can be dried can also be rewet if drying does not result in an irreversible change, e.g., coalesced dispersions or loss of a volatile solubilizing component. Accordingly, repeated application of fresh ink to the ink initially set in place ("dried") on plate 105 will rewet the previously applied ink as the solvent component of the fresh ink partitions itself between the fresh ink and the underlying "dry ink" image feature. The result is a softening image feature that erodes over time (becoming easier to remove); an image feature that is dry rather than cured to a durable state will be easier to remove (erase) at any point in the process.

2. System Components 2.1 Laser System

The laser(s) 118 used to remove dampening fluid or stabilize ink desirably deliver high power (e.g., at least 10 W) and may be, for example, solid-state devices such Nd:YAG, Nd:YLF or Nd:$YVO_4$ lasers, or fiber lasers, having an emission peak ($\lambda_{max}$) suited to the application; devices that emit in the near-infrared region can be used to advantage. In the arrangement conceptually illustrated in FIG. 1, a controller 130 operates the driver(s) (not shown) of laser(s) 118 to produce an imaging burst when appropriate points on lithographic surface 105*s* reach opposition to the laser output. In general, the driver preferably includes a pulse circuit capable of generating at least 100,000 laser-driving pulses/second, with each pulse being relatively short, i.e., on the order of nanoseconds.

Suitable optical components to focus the laser output onto the surface 105*s* as an image spot are well-known in the art. Controller 130 governs operation of the laser(s) 118, and receives data from two sources. The angular position of cylinder 105 with respect to the laser output is constantly monitored by a detector 133, which provides signals indicative of that position to controller 130. In addition, an image data source (e.g., a computer) 135 also provides data signals to controller 130. The image data provides relative reference points on cylinder 105 where image spots are to be written. Controller 130, therefore, correlates the instantaneous relative positions of laser(s) 118 and lithographic surface 105*s* (as reported by detector 133) with the image data to actuate the appropriate laser driver(s) at the appropriate times during scan of cylinder 105. The driver and control circuitry required to implement this scheme is well-known in the art.

Figure 2A:
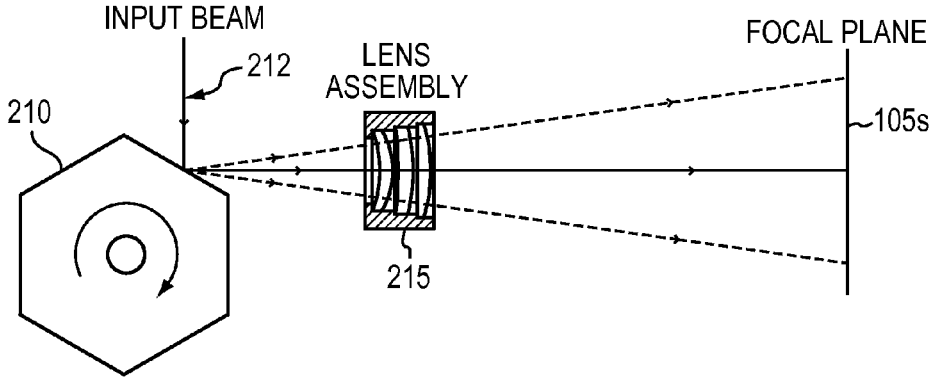
FIG. 2A schematically illustrates, in plan, a polygon-based scanner system useful in the practice of the present invention.

Axial scanning is preferred—that is, the laser beam sweeps across the cylinder surface 105*s* from end to end, applying one or more lines of image spots with each sweep. Any suitable axial scanning system may be used to advantage. One approach, shown in FIG. 2A, utilizes a rotating, multi-facet polygon 210 to scan a laser beam 212 axially across the cylinder surface 105*s*. The polygon 210 directs the beam through a suitable lens assembly 215 (e.g., an F-θ lens), which focuses it onto the cylinder surface, and as the polygon 210 rotates, it draws the beam 212 axially across that surface. As the beam is scanned, it is pulsed (using the controller system described above) so as to deliver energy at appropriate surface locations. The laser source may, for example, be a 20 W fiber laser emitting at a wavelength from 900 nm to 1600 nm, e.g., 1064 or 1550 nm.

Figure 2B:
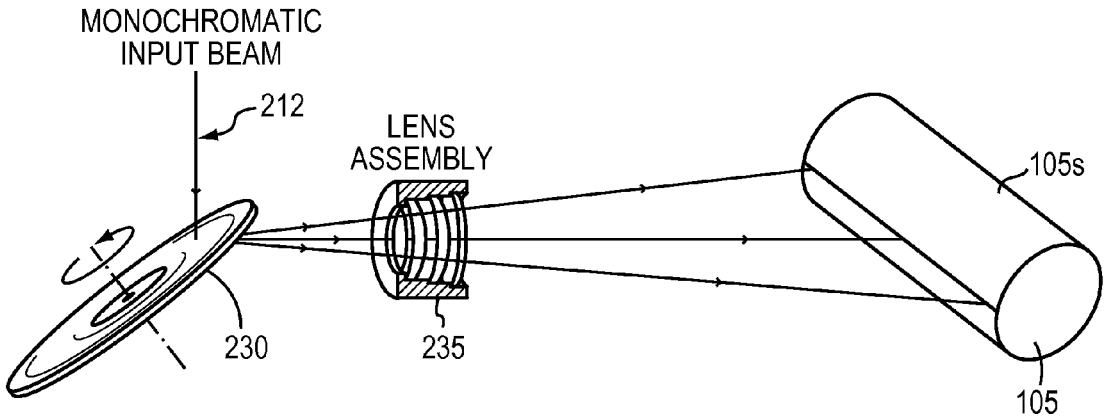
FIG. 2B schematically illustrates, in perspective, a holographic scanner system useful in the practice of the present invention.

Another approach, shown in FIG. 2B, utilizes holography. In particular, a monochromatic beam 212 is directed at a spinning holographic deflector 230, which intercepts the beam 212 and, as the deflector rotates, causes the beam 212 to scan across the cylinder surface 105*s*. Holographic scanner spinners are well known, and may be transparent or opaque depending on whether the arrangement is of the transmission or reflection type. Once again, the beam passes through a suitable lens arrangement 235.

2.2 Cylinder 105

Figure 3A:
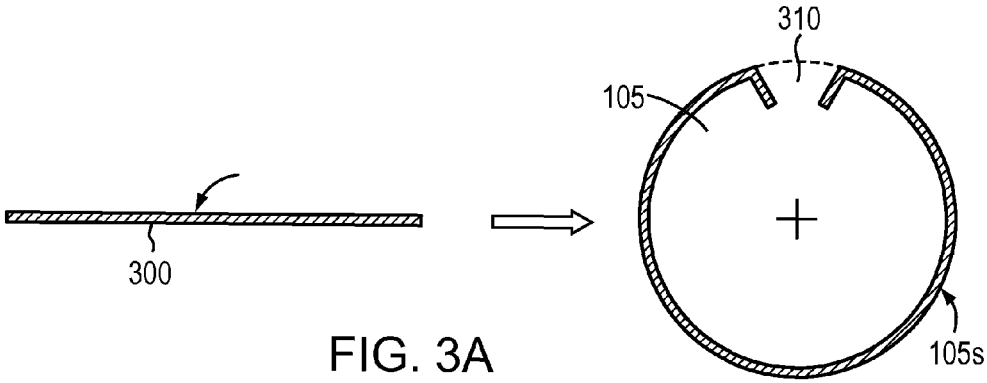
FIGS. 3A-3C illustrate different cylinder configurations in accordance with the invention.
Figure 3B:
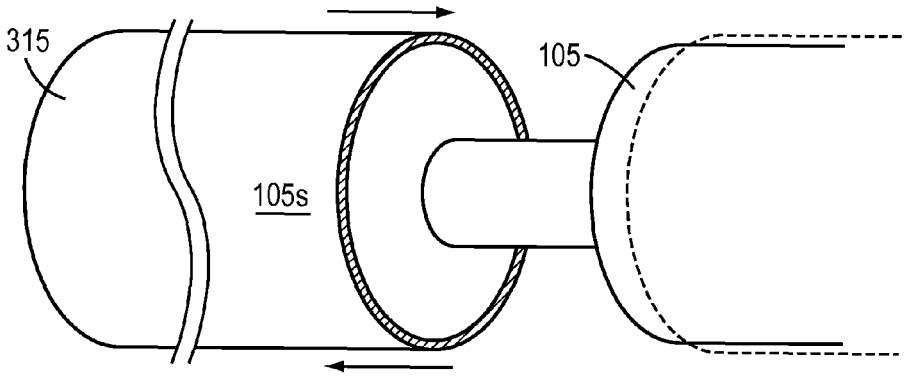

As noted above, metal surface 105*s* may be the surface of the cylinder 105 itself, or a metal surface layer or sheet (typically having a thickness of 0.006 inch or less) applied thereto. For example, as shown in FIG. 3A, a titanium sheet 300 may be wrapped around cylinder 105 and its edges crimped securely over the edges in a gap 310 in cylinder 105. Alternatively, as shown in FIG. 3B, the metal may take the form of a sleeve 315, which slides over cylinder 105. The sleeve 315 may be secured to cylinder 105 by clamps or other suitable engagements.

Figure 3C:
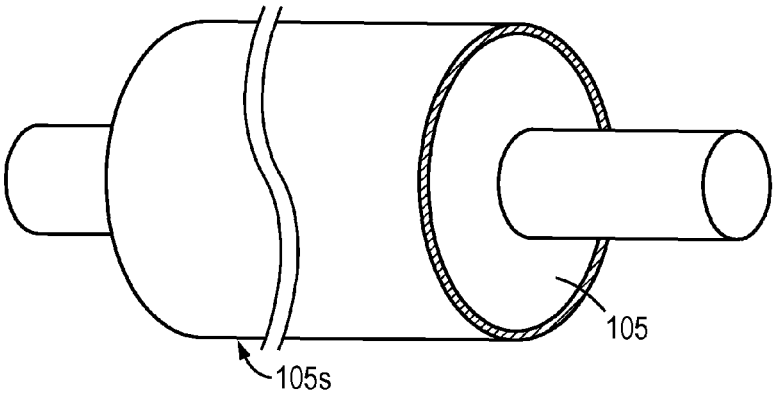

In still another alternative, illustrated in FIG. 3C, the cylinder 105 is itself fabricated from the metal whose surface 105*s* is presented on the exterior.

2.3 Inking System 110

The inking system 110 has four basic functions: to move ink from an ink fountain to the lithographic surface 105*s*; to break down a thick charge of ink into a thin uniform film; to work the ink into printing condition; and to remove image repeats on the form from previous printing cycles.

A representative inking system for a sheet-fed press in accordance with the invention has a series of rollers (typically on the order of ten) and includes an ink fountain (i.e., a pan that contains the ink supply); a ductor or ductor roller (i.e., a transfer roller that alternately contacts the ink fountain roller and the first roller of the ink train); form rollers (i.e., the last rollers of the ink train, usually having different diameters) that apply the ink to lithographic surface 105*s*; and, in some embodiments, an oscillator or vibrator (i.e., one or more gear- or chain-driven rollers that not only rotate but oscillate from side to side). In addition, inking system 110 may include intermediate rollers, i.e., friction- or gravity-driven rollers between the ductor and form roller(s) that transfer and condition the ink. These are often referred to as "distributors" if they contact two other rollers or "riders" if they contact a single roller (such as an oscillator). This "roller train" typically includes both hard and soft rollers.

A relatively long roller train is necessary in connection with sheet-fed offset inks useful in accordance with the invention. These inks are both thixotropic and pseudoplastic, the latter property causing the initially large apparent viscosity to be greatly reduced under the shear provided by the rollers. The apparent viscosity decreases with time under a constant shear rate and also decreases with increasing shear rate. Suitable products include the sheet-fed inks available from Flint Ink (Flint Group) under the ARROWSTAR and K+E names; the REFLECTA and ALPHA VEG products marketed by Hostmann-Steinberg (Huber Group); and the LIBERTY and SPRINT inks marketed by Kohl & Madden (Sun Chemical Group).

The hard rollers are usually steel covered with copper, ebonite or nylon. The soft rollers (ductor, intermediate and form) are typically synthetic rubber or other polymer; they may be PVC (polyvinl chloride), Buna-N (copolymer of butadiene and acrylonitrile) or polyurethane.

More specifically, the ink is formed by the fountain roller (a metal roller that turns intermittently or continuously); a fountain blade, which may be a spring steel plate, steel segments or plastic approaching the fountain roller at an angle; and two fountain cheeks, which are vertical metal pieces that contact the fountain roller edges. As the fountain roller turns, the majority of the ink is held back by the blade, which is very close to the fountain roller. The distance between the blade and fountain roller is determined by the fountain keys, which can be adjusted to control the amount of ink delivered to different areas of the plate.

The ductor roller—the first roller in the train—feeds a metered amount of ink from the fountain to the inking system by alternately contacting the fountain roller and the first oscillator. A properly timed ductor roller contacts the oscillator when the form rollers are in the plate gap. This negates the effect of ductor shock, i.e., the vibration sent through the system when the ductor first contacts the oscillator. The oscillators accept ink from the ductor, passing it onto the remaining rollers in the train where the ink is worked down to a smooth film. An inking system may have several oscillators (also called drums or vibrators) which are usually made of steel tubing covered with copper, ebonite, nylon or some other oil receptive material. They move laterally (side to side) at least once every revolution of the plate cylinder. This smoothes out the ink film and reduces banding.

The distributors are resilient rollers that carry the ink from one oscillator to another, and are driven by surface friction contact with oscillators. Riders are hard rollers that make contact with only a single roller and do not transfer ink; they help condition the ink by increasing the ink path and collect debris such as paper fiber and dried ink. The form rollers are resilient rollers that contact the plate. These usually have different diameters to reduce mechanical ghosting (i.e., ghost images appearing in the printed image due to uneven ink take-off from the form rollers). They lift off from the plate when the press is idling.

Another suitable approach to inking is the ANICOLOR system, a "short" zoneless inking unit, marketed by Heidelberg.

2.4 Dampening System 115

The dampening system 115 applies a polar liquid to the plate 105 before it is inked. This keeps the non-image area moistened so that it will not accept ink. Gum in the fountain solution adsorbs on the non-image area of surface 105*s* to keep it water-wet. The gum does not adsorb on the image area which is not water-wet; this area is generally oil-wet. A concentrate used to mix a fountain solution is called fountain concentrate, fountain etch or simply etch. These usually contain Gum Arabic or synthetic gums for desensitizing. Most dampening solutions are acidic (pH 4-5) because the gum performs best under acid conditions. A commercial dampening solution may also include corrosion inhibitors to prevent reactions with the plate; a pH buffer; wetting agents such as isopropanol or its substitutes; a fungicide to prevent mildew and the growth of fungus and bacteria in the dampening system; and/or an antifoaming agent facilitate even distribution of dampening solution. Some concentrates may require added alcohol in addition to water. It should be noted, however, that polar liquids other then dampening fluids (e.g., plain water) may also be employed.

Suitable dampening solutions include UNIVERSAL PINK, marketed by Day International (Flint Group); the RYCOLINE, GREEN DIAMOND and LIBERTY products from Sun Chemical Group; and DIRECT FLUID, marketed by Hostmann-Steinberg (Huber Group).

The effectiveness of the dampening solution depends on the local water supply. Hard water requires stronger acid than soft. To assure the most consistent performance, it is preferable to use distilled or deionized water. The plate-wetting characteristics depend in part on the surface tension of dampening solution, and this is reduced by both the gum (surfactant) and the alcohol (co-surfactant). The alcohol also increases the viscosity of the dampening solution, allowing a thicker layer of dampening solution to be applied to the non-image area of the plate. Alcohol evaporates faster than water, limiting the amount of dampening solution that reaches the paper, and also reduces the tendency of ink to emulsify into the dampening solution.

Dampening systems are classified according to whether the water flow is intermittent or continuous, and whether cloth form rollers are employed to transfer fountain solution to the plate. Of the possible combinations, three are in common use. So-called "conventional" dampening systems utilize dampening rollers that are separate from the inking system in conjunction with cloth-covered form rollers and ductor rollers in both ink and water fountains. In a combined ink and dampening system, fountain solution is carried to the plate on ink-covered rollers. Ductor rollers are included in the ink and dampening fountains. Since there is no distinction between ink and dampening form rollers, no cloth can be used on the form rollers. These configurations are called integrated dampening systems or indirect dampening systems. So-called "continuous-flow" dampening systems do not employ ductor rollers to deliver dampening solution. There are two types—inker-feed and plate-feed—and both use metering rollers instead of ductors. The inker-feed systems operate in a manner similar to integrated dampening systems in that only one set of form rollers is employed. Plate-feed systems have separate ink and water trains like conventional dampening systems and may employ cloth-wrapped form rollers.

3. Exemplary Press Implementations

Figure 4:
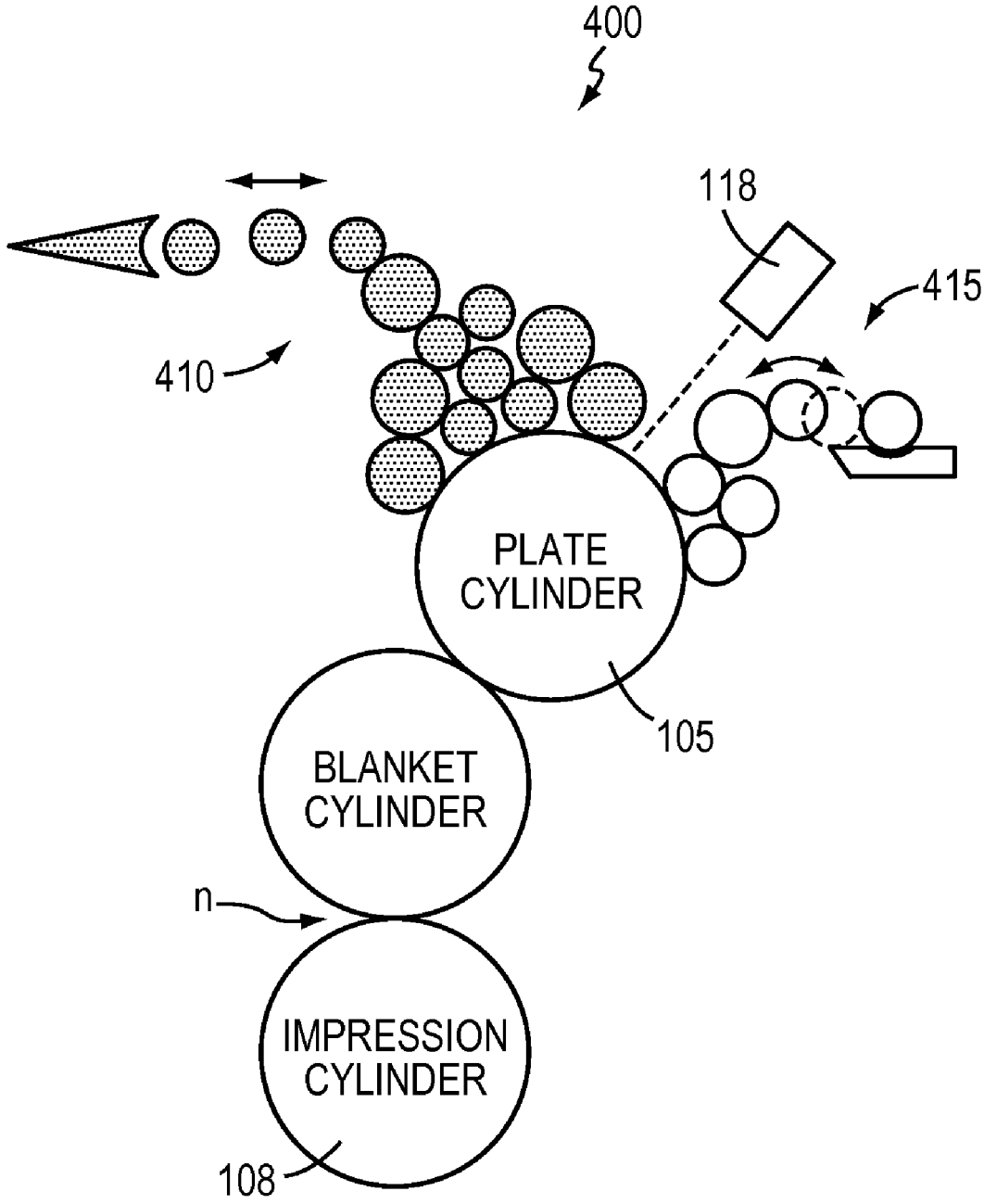
FIG. 4 schematically illustrates a printing station suitable for use in connection with the present invention.

FIG. 4 shows the components of a representative print station 400 suitable for implementing the present invention, and which may be used in connection with any suitable press configuration. The print station 400 includes a plate cylinder 105, a blanket cylinder 107 and an impression cylinder 108, as well as an inking system 410 and a dampening system 415 as described above. In particular, inking system 410 and dampening system 415 include conventional trains of form, distribution, ductor and fountain rollers as schematically indicated.

The print station 400 applies a subtractive ink in accordance with the color gamut (e.g., the CMYK gamut) selected by the press operator. The press includes at least as many print stations as there are colors in the gamut, and may include further stations to apply, for example, a finishing treatment. In a linear press, the print stations 400 are arranged in an in-line configuration; see, e.g., U.S. Pat. No. 4,936,211. The printing path transports a cut sheet of recording material from a source through the successive print stations, following which printed sheets are collected in a stack. Alternatively, the system may be web-based rather than sheet-fed. The control systems associated with each of the printing stations store (or retrieve from a central storage facility) "color separations" of the image to be printed, each separation corresponding to one color of the gamut.

In a central-impression press, the recording medium is pinned to the surface of a master drum 108, which, as it rotates, brings the medium into contact with print stations arranged circumferentially therearound; see, e.g., the '211 patent mentioned above.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

The invention claimed is:

1. A method of printing comprising the steps of:

a. providing a hydrophilic, ink-receptive lithographic surface having a printing area;

b. applying ink to the printing area, the ink being adsorbed thereon;

c. exposing the ink-bearing printing area to laser output in an imagewise fashion, the laser output temporarily fixing the adsorbed ink on the printing surface;

d. applying a polar liquid to the printing area, the polar liquid removing ink that has not received laser exposure; and e. transferring the temporarily fixed ink to a recording medium via contact therewith.

2. The method of claim 1 further comprising the steps of erasing the printing area by application of an ink-removing medium and applying a new image by repeating steps (b) through (e).

3. The method of claim 1 wherein steps (b) through (d) are repeated at least once before step (e) is performed.

4. The method of claim 1 wherein the ink is a single-fluid ink comprising a colorant and an polar solvent such that the ink and the polar liquid are applied simultaneously, laser output removing the solvent but not the colorant.

5. The method of claim 1 wherein the lithographic surface is metal.

6. The method of claim 5 wherein the metal printing surface is titanium.

7. The method of claim 1 wherein the polar liquid is an aqueous dampening fluid.

8. The method of claim 1 further comprising the step of removing vapor and debris during the exposing step.

9. The method of claim 1, wherein the lithographic surface is in the form of a rotating drum.

10. The method of claim 1, further comprising cleaning the printing area after transferring the temporarily fixed ink.

* * * * *